US005088999A

United States Patent [19]

Bukoschek et al.

[11] Patent Number: 5,088,999

[45] Date of Patent: Feb. 18, 1992

[54] DEPILATION APPARATUS

[75] Inventors: Romuald L. Bukoschek, Klagenfurt; Norbert Schneider, Ebental, both of Austria

[73] Assignee: U.S. Philips Corporation, New York, N.Y.

[21] Appl. No.: 674,420

[22] Filed: Mar. 22, 1991

Related U.S. Application Data

[63] Continuation of Ser. No. 359,469, May 31, 1989, abandoned.

[30] Foreign Application Priority Data

Jun. 7, 1988 [AT] Austria ..... A1474/88
Feb. 10, 1989 [AT] Austria ..... A288/89

[51] Int. Cl.[5] ..... A61B 17/50
[52] U.S. Cl. ..... 606/133; 452/82; 452/102
[58] Field of Search ..... 606/131, 133; 452/71, 452/82, 102; 132/73, 736

[56] References Cited

U.S. PATENT DOCUMENTS 1,006,304 10/1911 Smith ..... 17/11.1 R
4,279,253 7/1981 Haes et al. ..... 128/355
4,811,458 3/1989 Nieuwelaar et al. ..... 17/11.1 R

FOREIGN PATENT DOCUMENTS 0245141 11/1987 European Pat. Off. ..... 128/355
2307491 12/1976 France ..... 128/355
0652899 12/1985 Switzerland ..... 128/355

*Primary Examiner*—C. Fred Rosenbaum
*Assistant Examiner*—William W. Lewis
*Attorney, Agent, or Firm*—Ernestine C. Bartlett

[57] ABSTRACT

A depilation apparatus is provided comprising at least one pair of depilation rollers (3, 4) which can be driven in opposite directions and whose circumferential surfaces have undulatory cross-sectional profiles with which they interengage circumferentially, one of said rollers being adapted to be driven by means of a motor, the undulatory cross-sectional profile of the circumferential surface extends linearly over the whole length of the rollers and the maximum diameter of the depilation rollers is selected to be of the order of magnitude of 4.5 mm and the number of crests of the cross-sectional profile is selected to be the order of magnitude of 10.

19 Claims, 4 Drawing Sheets

DEPILATION APPARATUS

This is a continuation of application Ser. No. 359,469, filed May 31, 1989, now abandoned.

Priority of applications Ser. Nos. A1474/88 and A288/89, filed on June 7, 1988 and Feb. 10, 1989 respectively, in Austria, is claimed under 35 U.S.C. 119.

FIELD OF THE INVENTION

The invention relates to a depilation apparatus comprising at least one pair of depilation rollers which are rotatable in opposite directions and whose circumferential surfaces have an undulatory cross-sectional profile with a maximum and a minimum diameter and at least four crests, which rollers interengage circumferentially with their cross-sectional profiles, one of said rollers being adapted to be driven by means of a motor, the depilation rollers performing a rotary movement which at the location where they interengage circumferentially is directed into the interior of the apparatus.

BACKGROUND OF THE INVENTION

Such a depilation apparatus is disclosed in FR-PS 2,079,667. In this known depilation apparatus the undulatory cross-sectional profile extends along a helical line over the whole length of the depilation rollers. FR-PS 2,079,667 does not disclose in detail how the two depilation rollers of a pair cooperate circumferentially with one another but merely states that the motor-driven depilation roller drives the other depilation roller, with which it cooperates circumferentially, in an opposite direction of rotation. Moreover, said FR-PS 2,079,667 does not define the dimensioning of the depilation rollers themselves. Series production of these known depilation rollers is found to be very difficult because the undulatory cross-sectional profile extends along a helical line over the whole length of the rollers.

SUMMARY OF THE INVENTION

An object of the invention to construct a depilation apparatus of the type defined in the opening sentence in such a way that it can be manufactured simply and guarantees a satisfactory depilation.

According to the invention this is achieved in that the undulatory cross-sectional profile extends linearly over the whole length of each depilation roller and in that the maximum diameter of the depilation rollers is selected to be of the order of magnitude of 4.5 mm and the number of crests of the cross-sectional profile is selected to be of the order of magnitude of 10. Herein order of magnitude is to be understood to mean possible deviations of up to approximately ±30% of the specified value. Since in accordance with the invention the undulatory cross-sectional profile extends linearly over the whole length of the depilation rollers the depilation rollers, themselves can be manufactured simply and accurately, thereby also ensuring a correct cooperation between the depilation rollers of a pair. In addition, the choice of the diameter of the depilation rollers as well as the shape chosen for their undulatory cross-sectional profile are found to be essential for a satisfactory depilation. If the diameter of the depilation rollers is too large, only long hairs will be gripped and if the diameter of the depilation rollers is too small, the force required for a reliable extraction of the hairs from their follicles cannot be produced. The same applies to the specified choice of the number of crests of the cross-sectional profile.

In a depilation apparatus in which the undulatory cross-sectional profile of the circumferential surfaces of the depilation rollers is sinusoidal, as is also the case in the depilation apparatus disclosed in FR-PS 2,079,667, referred to above it is also found to be advantageous if the depilation rollers intermesh tightly at the location of their maximum diameter and at the location of their minimum diameter respectively, and if the ratio of the maximum diameter to the difference between the maximum and the minimum diameter is selected to be of the order of magnitude of 7. This ensures that the hairs are gripped effectively and are extracted correctly from their follicles (rather than being nipped off), so that the hairs are removed completely and are not severed.

For the choice of the shape of the undulatory cross-sectional profile of the depilation rollers, it has also been found to be advantageous if the undulatory cross-sectional profile of the circumferential surfaces of the depilation rollers is a toothed-wheel profile having teeth with rounded tops, the depilation rollers intermeshing tightly only at the location of the tooth flanks of their cross-sectional profiles. This is found to result in the hairs being very reliably gripped and removed from their follicles because the hairs are already caught by the tooth flanks and gripped tightly between the flanks. For the choice of the toothed-wheel profiles all the profiles which are common in toothed-wheel technology may be considered.

However, it is found to be very advantageous if the toothed-wheel profile is involute. In this way the depilation rollers can be manufactured simply in analogy with toothed wheels having involute tooth profiles.

It is further found to be advantageous if at least one depilation roller is supported on pivotable arms by means of which it is urged circumferentially against the adjacent depilation roller under spring action. Thus, a very reliable cooperation between the depilation rollers of a pair and, consequently, a correct depilation is achieved in a simple manner. It is to be noted that resiliently pressing two depilation rollers against one another is known per se from FR-PS 2,307,491, but this is effected via the bearing means of the depilation rollers and is therefore comparatively intricate. However, in the present case this is effected simply by means of resiliently loaded pivotable arms, which may be constructed, for example, like an integral hinge, or in such a way that the arms themselves exhibit a spring action.

Moreover, it is found to be advantageous if the depilation rollers are driven with a speed of the order of magnitude of 1500 revolutions per minute. Such a speed of the depilation rollers is found to be advantageous because the extraction of the hairs from their follicles is effected comparatively rapidly and is therefore comparatively painless. However, if the speed with which the depilation rollers are driven is too high the hairs will no longer be caught reliably by the depilation rollers.

In a depilation apparatus comprising at least two pairs of depilation rollers it is found to be advantageous if the cross-sectional profile of one depilation roller of every pair of depilation rollers circumferentially engages the cross-sectional profile of a depilation roller of an adjacent pair, and only one depilation roller of all the depilation rollers is driven by the motor. Thus, only one depilation roller of a pair must be driven by the motor, all the other depilation rollers driving one another, which results in a very simple construction for the drive system. In contrast, in the afore-mentioned prior-art depilation apparatus every pair of depilation rollers is driven separately by a drive wheel, so that the relevant drive system is comparatively intricate.

In yet other preferred embodiments of the invention, when in a depilation apparatus comprising at least two pairs of depilation rollers which, viewed in a direction transverse to the longitudinal direction of the depilation rollers, are arranged opposite one another in spaced-apart pairs, it is found to be advantageous if the depilation rollers of two pairs are driven by means of a motor-driven gear wheel, which gear wheel viewed in a direction transverse to the longitudinal direction of the depilation rollers, drives the forward depilation roller of the depilation rollers of both pairs. In this way two pairs of depilation rollers are driven by a single gear wheel, while nevertheless the depilation rollers of every pair are driven in the correct direction, i.e. directed into the interior of the apparatus at the location of their circumferential interengagement. In comparison with the afore-mentioned prior-art depilation apparatus, this also results in a simple construction for the drive system of the depilation roller.

In this respect it is also found to be advantageous if every further pair of depilation rollers is driven by the adjacent depilation roller via gear wheels connected to the depilation rollers. It is evident that this also simplifies the construction of the drive system for all the depilation rollers.

It is also found to be advantageous if a skin-tautening roller is arranged at either side adjacent the depilation rollers and is driven in a direction of rotation which is directed away from the apparatus at the location of the depilation area, which ensures that the hairs are caught very effectively by the depilation rollers and, conversely, that the skin cannot be caught between the depilation rollers. The cross-sectional profile at the circumference of the skin-tautening rollers may then be either smooth or undulatory.

In this respect it is further found to be advantageous if the skin-tautening rollers have a diameter larger than the maximum diameter of the depilation rollers. This further enhances the skin-tautening effect.

It is found to be advantageous if the depilation rollers are arranged on a support, which support is arranged on the apparatus so as to be pivotable away from the apparatus. This enables the depilation apparatus to be cleaned in a simple way similarly to dry-shavers.

However, it is also found to be advantageous if the depilation rollers are arranged on a support which is detachably connected to the apparatus. This also provides a possibility of simply cleaning or exchanging the depilation rollers in the same way as in dry-shavers.

DETAILED DESCRIPTION OF THE PREFERRED EMBODIMENTS

Figure 1:
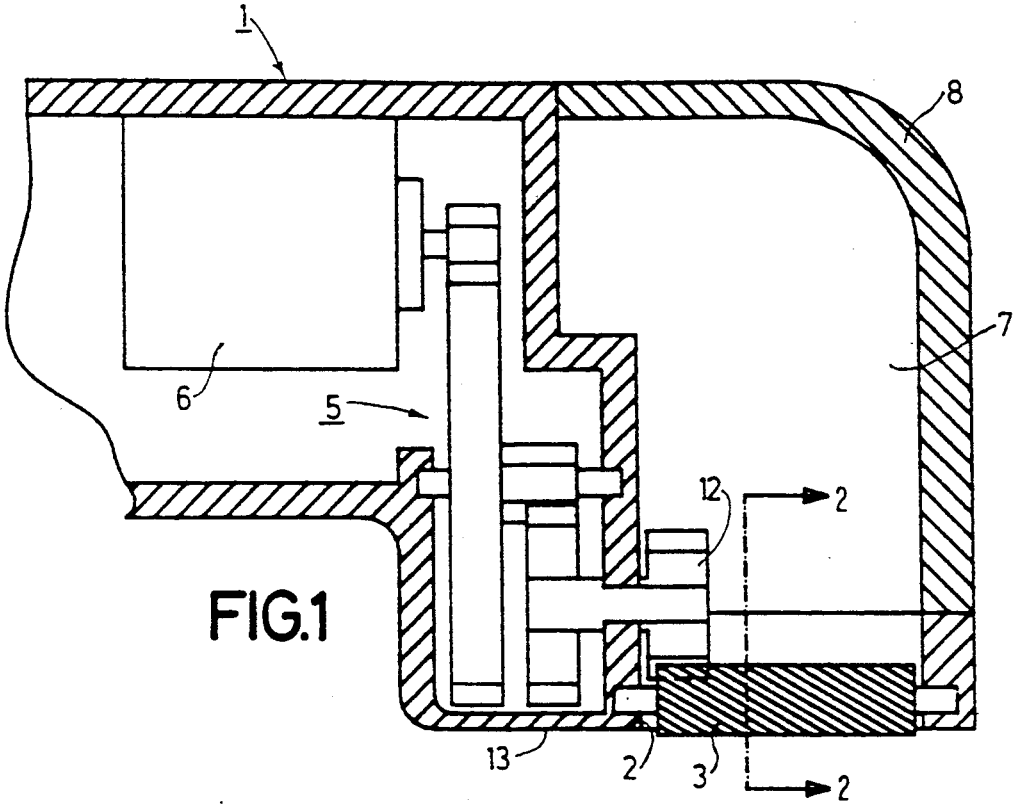
FIG. 1 is a longitudinal sectional view showing a part of a depilation apparatus which for the removal of hairs comprises a pair of depilation rollers which are rotatable in opposite directions and whose circumferential surfaces have sinusoidal cross-sectional profiles with which they interengage circumferentially.
Figure 2:
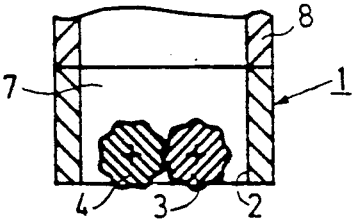
FIG. 2 is a sectional view taken on the line II—II in FIG. 1.

In FIGS. 1 and 2 the housing 1 of a depilation apparatus has an opening 2 at the location of which a pair of depilation rollers 3 and 4 is rotatably arranged, FIG. 1 showing only the depilation roller 3. As can be seen in FIG. 2, the circumferential surfaces of the depilation rollers 3 and 4 each have an undulatory, in the present case sinusoidal, cross-sectional profile with which said rollers interengage circumferentially. One of the two depilation rollers, in the present case the depilation roller 3, can be driven by means of a motor 6 via a, for example, multi-stage gear mechanism 5, the direction of rotation being selected in such a way that the depilation roller 3 performs a rotary movement which at the location where it engages circumferentially with the depilation roller 4 is directed into the interior of the apparatus. Consequently, the depilation roller 3 is driven clockwise in FIG. 2, thereby driving the depilation roller 4 in the counterclockwise direction as a result of its circumferential cooperation with this roller. In this way the two depilation rollers 3 and 4 are capable of gripping a hair caught between them and exerting a pulling force on this hair to extract it from its follicle. The depilation rollers 3 and 4 then feed a hair thus extracted into a collecting chamber 7 which adjoins said rollers. This collecting chamber 7 may for example be closed by a cover 8 which is detachable from the housing 1 of the apparatus for cleaning purposes.

For the correct operation of such a depilation apparatus the dimensioning of the depilation rollers and in particular that of the cross-sectional profile of the circumferential surfaces of said rollers is found to be very important. Therefore, the sinusoidal cross-sectional profiles exert linearly over the full length of the depilation rollers and interengage tightly at the location of their maximum diameter and at the location of their minimum diameter respectively, the maximum diameter of the depilation rollers being of the order of magnitude of 4.5 mm, the ratio of the maximum diameter to the difference between the maximum and the minimum diameter being of the order of magnitude of 7, and the number of crests of the cross-sectional profile being of the order of magnitude of 10. As mentioned previously, order of magnitude is to be understood to mean possible deviations of up to approximately ±30% of the specified value.

Since the sinusoidal cross-sectional profile extends linearly over the full length of the depilation rollers, the depilation rollers can be of simple construction and can therefore be manufactured simply, because they have a simple straight and continuous shape. They function in the same way as two intermeshing gear wheels, so that as the motor-driven depilation roller is rotated it will positively drive the depilation roller which is not driven by the motor, thereby guaranteeing that the two depilation rollers cooperate correctly to extract the hairs. For this purpose it is found to be essential that the two depilation rollers of a pair tightly mesh with one another at the location of their maximum diameter and at the location of their minimum diameter, respectively. This means that in the relevant positions of the two depilation rollers one depilation roller at the location of its maximum diameter is in contact and in mesh with the other depilation roller at the location of its minimum diameter, as can be seen in FIG. 2. This guarantees that a hair is reliably caught and gripped tightly between the depilation rollers so that as the depilation rollers rotate a pulling force is exerted on the hair to extract it from its follicle. Such a tight intermeshing of the two depilation rollers at the location of their maximum diameter and their minimum diameter respectively is then achieved, for example, in that their axial spacing is selected to correspond to half the sum of the maximum and minimum diameter. However, in principle it is also possible to urge the two depilation rollers resiliently against one another. The choice of the diameter of the depilation roller is further based on the recognition of the fact that when the diameter of the depilation rollers is too large only comparatively long hairs will be gripped and when the diameter of the depilation rollers is too small the pulling forces required for a reliable extraction of the hairs from their follicles cannot be produced. Finally, the specifications for the ratio of the maximum diameter to the difference between the maximum and the minimum diameter and the number of crests of the cross-sectional profile define the shape of the sinusoidal cross-sectional profile of the circumferential surfaces of the depilation rollers with respect to the height and number of crests in such a way that also a reliable cooperation between the two depilation rollers is guaranteed so that the hairs to be removed are effectively gripped and extracted from their follicles by the depilation rollers.

Figure 3:
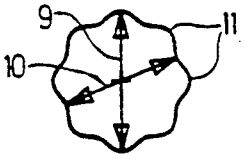
FIG. 3 shows to an enlarged scale the cross-sectional profile of the depilation rollers used in the embodiment shown in FIG. 1.

FIG. 3 shows the sinusoidal cross-sectional profile of the circumferential surfaces of the depilation rollers 3 and 4 used in the present embodiment, the maximum diameter being indicated by the double arrow 9, the minimum diameter by the double arrow 10, and the crests of the cross-sectional profile bearing the reference numeral 11. In this practical case the maximum diameter 9 selected for the depilation rollers is 4 mm, the value chosen for half the difference between the maximum diameter 9 and the minimum diameter 10, i.e. the height of the crests 11, is 0.25 mm, and the selected number of crests 11 is 8. In this case the ratio of the maximum diameter to the difference between the maximum and the minimum diameter is consequently 8. This results in a reliable cooperation between the two depilation rollers and a very effective depilation.

The length selected for the depilation rollers also influences the depilation quality. If the length of the depilation rollers is too short the number of hairs gripped and removed at the same time over their whole length will be comparatively small, so that depilation takes a comparatively long time. However, if the depilation rollers are too long it is no longer possible to achieve a reliable circumferential cooperation between the depilation rollers over their whole length owing to tolerances in the manufacture of the depilation rollers, so that the depilation rollers no longer intermesh tightly at the location of their maximum diameter and minimum diameter respectively, as a result of which the hairs are no longer gripped and extracted effectively at such locations. Therefore, the length selected for the depilation rollers in the present embodiment is approximately 12 mm, so that here the ratio between the maximum diameter of the rollers and their length is 1 to 3.

The choice of the speed with which the depilation rollers are driven also influences the depilation quality because the reliable gripping of the hairs will be impaired if the depilation rollers are driven too fast. Conversely, if the depilation rollers are driven too slowly depilation will be comparatively painful because the hairs are extracted only slowly from their follicles. In this respect, preferably the depilation rollers are driven with a speed of the order of magnitude of 1500 revolutions per minute. In the present embodiment the depilation roller 3 is driven by means of the multi-stage gear mechanism 5 driven by the motor 6 in that a gear wheel 12 of the gear mechanism 5 is directly in mesh with the sinusoidal cross-sectional profile of the circumferential surface of the depilation roller 3. This results in a simple and compact drive for the depilation roller 3, in particular enabling the depilation roller 3 and hence the depilation roller 4 cooperating with it to be arranged in a flat portion 13 of the housing 1, so that the depilation apparatus can be moved smoothly over the skin areas to be depiled. At the location where it cooperates circumferentially with the gear wheel 12 the depilation roller 3 may be provided, if necessary, with a more pronounced circumferential cross-sectional profile for a very reliable power transmission from the gear wheel 12 to the depilation roller 3. It is obvious that, in principle, it is also possible to provide special teeth at the location of this circumferential portion of the depilation roller 3 with which the gear wheel 12 cooperates, or even to provide a separate gear wheel connected to the depilation roller 3 for cooperation with the gear mechanism 5.

Figure 4:
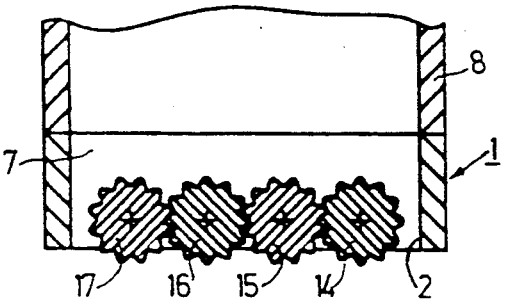
FIG. 4 is a view, similar to FIG. 2, of a depilation apparatus comprising two pairs of depilation rollers, the cross-sectional profile of a depilation roller of a first pair engaging circumferentially with the cross-sectional profile of a depilation roller of the second pair.

The embodiment shown in FIG. 4 comprises two pairs of depilation rollers whose circumferential surfaces again have a sinusoidal cross-sectional profile, the first pair comprising the depilation rollers 14 and 15 and the second pair comprising the depilation rollers 16 and 17. The depilation rollers are arranged in such a way that the cross-sectional profile of one depilation roller of every pair of depilation rollers circumferentially engages with the cross-sectional profile of a depilation roller of the adjacent pair, in the present example in such a way that the cross-sectional profile of the depilation roller 15 of the depilation-roller pair 14, 15 circumferentially engages with the cross-sectional profile of the depilation roller 16 of the depilation-roller pair 16, 17. Of all the depilation rollers 14, 15, 16 and 17 only one depilation roller is driven by the motor, for example the depilation roller 14. As a result of the cooperation between the depilation rollers 15 and 16 of the two depilation-roller pairs 14, 15 and 16, 17 the drive of the first depilation-roller pair 14, 15 is also transmitted to the second depilation-roller pair 16, 17. Thus, it is not necessary to provide a separate drive for the second depilation-roller pair 16, 17, which results in a very simple overall construction of the drive system. Each of the two depilation-roller pairs 14, 15 and 16, 17 then operates independently in the depilation process.

Figure 5:
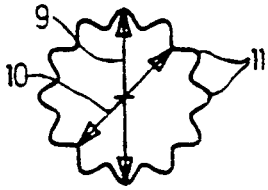
FIG. 5 shows to an enlarged scale the cross-sectional profile of the depilation rollers used in the embodiment shown in FIG. 4.

In the embodiment of FIG. 4, the criteria for the choice of the dimensions of the depilation rollers 14, 15, 16 and 17 are the same as those given for the embodiment described above with reference to FIGS. 1 and 2. FIG. 5 shows the sinusoidal cross-sectional profile of the circumferential surfaces of the depilation rollers 14, 15, 16 and 17, the maximum diameter being indicated by the double arrow 9, the minimum diameter being indicated by the double arrow 10, and the crests of the cross-sectional profile bearing the reference numeral 11. In this embodiment the selected maximum diameter 9 is 5 mm, the value chosen for half the difference between the maximum diameter 9 and the minimum diameter 10, i.e. the height of the crests 11, is 0.5 mm, and the selected number of crests 11 is 12. In the present case the ratio of the maximum diameter to the difference between the maximum and the minimum diameter is consequently 5. This again results in a very effective depilation, which is achieved in particular owing to the larger number of crests 11 of the sinusoidal cross-sectional profile of the circumferential surface.

Figure 6:
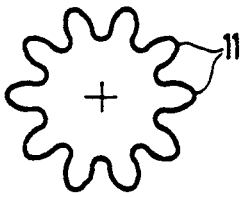
FIG. 6 is a view, similar to FIG. 5, of the cross-sectional profile of a depilation roller formed as a toothed-wheel profile having teeth with rounded tops.

FIG. 6 shows the undulatory cross-sectional profile of the circumfernetial surface of a depilation roller, which is constructed as a toothed-wheel profile whose teeth have rounded tops. In the present case the toothed-wheel profile is involute, which can be manufactured comparatively simply. It is obvious, however, that other toothed-wheel profiles as customary for toothed wheels may be used. In practice, the maximum diameter selected for the cross-sectional profile is 4.5 mm and the selected number of crests 11 is 10, as is illustrated. Since in this embodiment a toothed-wheel profile has been selected for the undulatory cross-sectional profile of the circumferential surface, no special choice is necessary for the height of the crests 11, because the circumferentially cooperating depilation rollers of a pair should merely have to mesh tightly at the location of the tooth flanks of their cross-sectional profiles.

Figure 7:
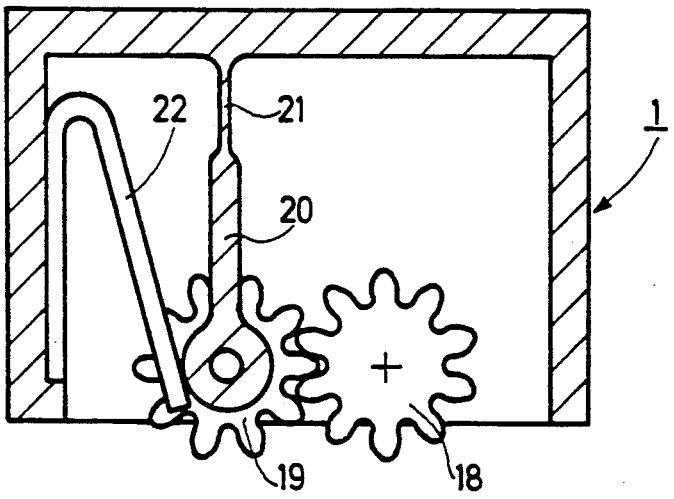
FIG. 7 is a view similar to FIG. 2 and shows a depilation apparatus comprising a pair of depilation rollers whose circumferential surfaces have a cross-sectional profile as shown in FIG. 6, one of said rollers being supported on a pivotable arm and being circumferentially urged against the other depilation roller under spring action.

FIG. 7 illustrates the use of a depilation roller such as shown in FIG. 6 in a depilation apparatus comprising one pair of depilation rollers and shows that in the present case the depilation rollers only intermesh tightly at the location of the tooth flanks of their cross-sectional profiles. The depilation roller 19 is now supported on pivotable arms, of which only one arm 20 is visible in FIG. 7. In the present example the arms can be pivoted in that they are arranged on the apparatus by means of integral hinges 21. However, it is obvious that the arms can also be pivotally supported via other customary supporting means. Each of said pivotable arms cooperates with a blade spring 22 which acts to urge the depilation roller 19 circumferentially against the adjacent depilation roller 18 which in the present case is stationarily and rotatably mounted on the apparatus. This ensures a correct circumferentially cooperation between the depilation roller 18 and 19 so that the hairs to be extracted are effectively caught by and gripped between the depilation rollers in order to be removed. Such a method of resiliently urging the depilation rollers circumferentially against one another may, of course, also be used in the case of more than two circumferentially cooperating depilation rollers, as in the embodiment shown in FIG. 4. An outer depilation roller should then be mounted stationarily and rotatably on the apparatus and the other depilation rollers should be supported on pivotable arms, the arms of the outer depilation roller being subjected to spring action to urge all the depilation rollers resiliently against one another at their circumferential surfaces.

Figure 8:
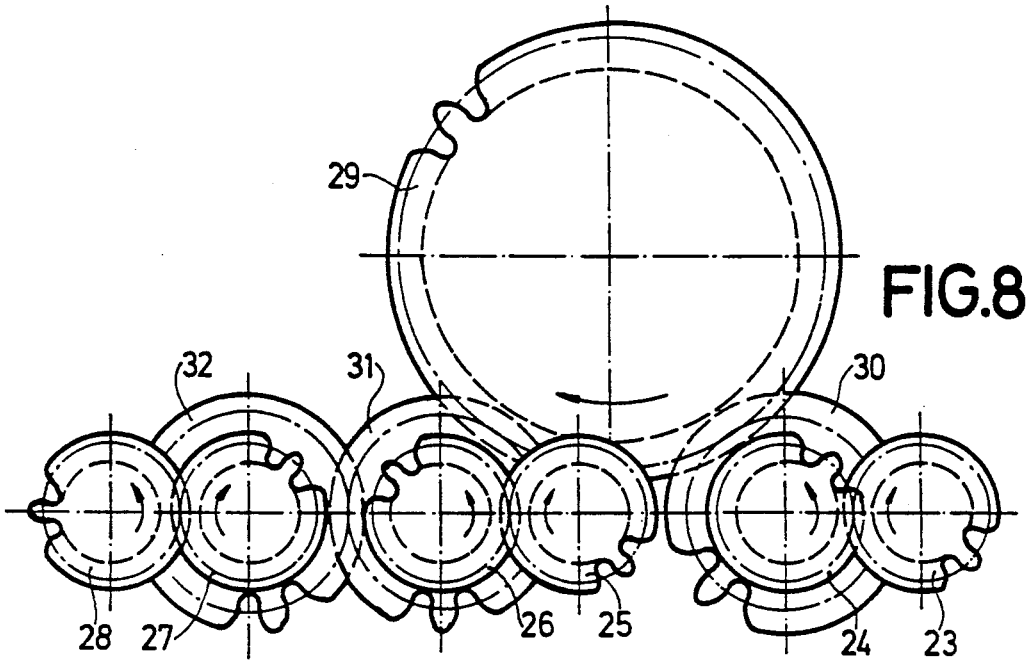
FIG. 8 shows diagrammatically three pairs of depilation rollers, which are arranged opposite one another in spacedapart pairs, and a drive system for the depilation rollers.

The embodiment shown in FIG. 8 comprises three pairs of depilation rollers, i.e. a first pair comprising the depilation rollers 23, 24, a second pair comprising the depilation rollers 25, 26 and a third pair comprising the depilation rollers 27, 28, adjacent depilation-roller pairs being spaced apart and arranged opposite one another viewed transversely of the longitudinal direction of the depilation rollers, so that in this case only the depilation rollers of every pair cooperate circumferentially with one another. As is indicated diagrammatically, the undulatory cross-sectional profiles of the circumferential surfaces of the depilation rollers are again formed by toothed-wheel profiles having teeth with rounded tops. In order to drive the depilation rollers by means of the motor there is provided a gear wheel 29, which viewed in a direction transverse to the longitudinal directions of the depilation rollers drives the forward depilation rollers 24 and 26 of the two depilation-roller pairs 23, 24 and 25, 26 via the gear wheels 30 and 31 connected to said rollers. Thus, two pairs of depilation rollers are driven simultaneously by the motor via one gear wheel 29, the choice of the driven depilation rollers ensuring that the depilation rollers 23, 24 and 25, 26 of the two pairs are always driven in the correct direction of rotation, so that the depilation rollers of every pair perform a rotation which at the location where they mesh circumferentially is directed into the interior of the apparaus. In order to drive the third depilation-roller pair 27, 28 the gear wheel 31 connected to the adjacent depilation roller 26 cooperates with a gear wheel 32 connected to the depilation roller 27, so that this third pair of depilation rollers 27, 28 is also driven in the correct direction of rotation, thus ensuring that the depilation rollers 27, 28 also perform a rotation which is directed into the interior of the apparatus at the location where they mesh circumferentially. As can be seen, such a drive system is of very simple construction.

Figure 9:
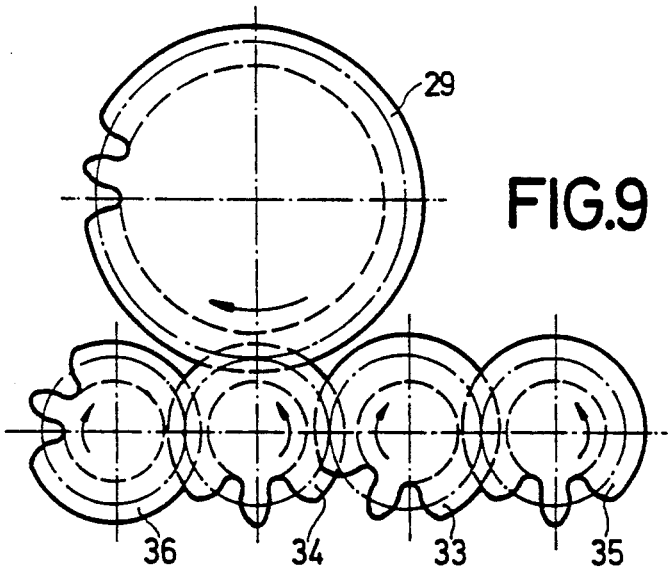
FIG. 9 shows diagrammatically a pair of depilation rollers to each of which a skin-tautening roller is juxtaposed.

The embodiment shown in FIG. 9 again comprises a pair of depilation rollers 33, 34, which are driven by the motor via a gear wheel 29 which directly cooperates with the circumferential toothed-wheel profile of the depilation roller 34. In the present embodiment a skin-tautening roller 35, 36 is arranged adjacent each of the depilation rollers 33 and 34 respectively and is driven in a direction of rotation which at the location of the adjacent depilation roller is directed away from the apparatus. In the present case the skin-tautening rollers also have a circumferential toothed-wheel profile in the same way as the depilation rollers 33 and 34 themselves, so that for driving the skin-tautening rollers 35, 36 the circumferential profiles of these rollers can simply mesh with the circumferential profiles of the ajdacent depilation rollers 33 and 34 respectively, said skin-tautening rollers directly performing a rotation which is directed away from the apparatus. In this way the skin-tautening rollers tend to tauten the skin area situated between them, causing the hairs in this skin area to be erected so that they are more likely to be caught and extracted by the depilation rollers 33 and 34. Tautening of the skin further ensures that the skin itself is not caught and pinched between the depilation rollers. Thus, depilation is effected correctly and reliably without irritation of the skin.

Figure 10:
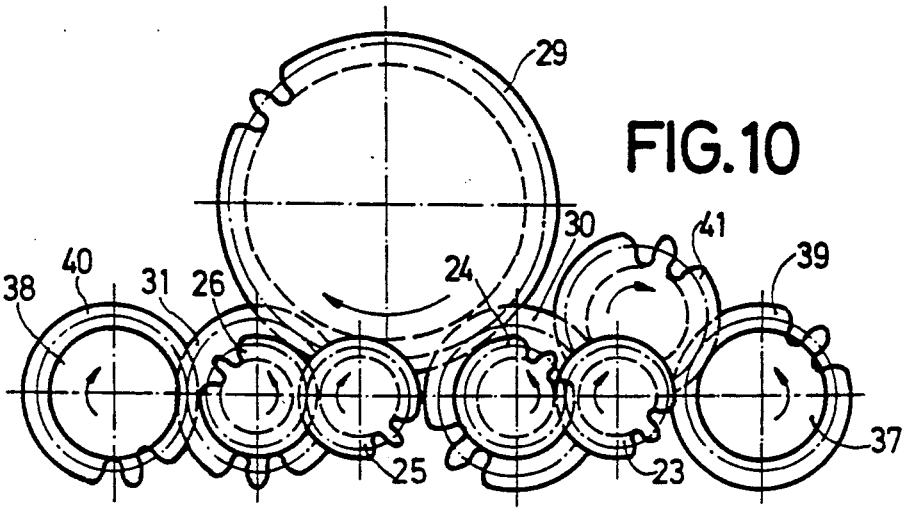
FIG. 10 shows diagrammatically two pairs of depilation rollers with juxtaposed skin-tautening rollers.

The embodiment shown in FIG. 10, similarly to the embodiment shown in FIG. 8, comprises two pairs of depilation rollers 23, 24 and 25, 26, which are again arranged opposite one another in spaced-apart pairs viewed in a direction transverse to the longitudinal direction of the depilation rollers. Again the depilation rollers are driven by means of the motor via a gear wheel 29 which cooperates with gear wheels 30 and 31 connected to the depilation rollers 24 and 26. Also in this embodiment skin-tautening rollers 37 and 38 are arranged adjacent the respective depilation rollers 23 and 26 and are driven in directions of rotation which at the location of the adjacent depilation rollers are directed away from the apparatus. Here the skin-tautening rollers 37 and 38 are circumferentially smooth and are spaced from the adjacent depilation rollers 23 and 26 respectively. The skin-tautening rollers 37 and 38 are each provided with a gear wheel 39 and 40 respectively to drive these rollers, the gear wheel 40 of the skin-tautening roller 38 cooperating with the gear wheel 31 of the adjacent depilation roller 26, a further gear wheel 41 being provided which, for driving the skin-tautening roller 37, cooperates both with the gear wheel 39 of the skin-tautening roller 37 and with the gear wheel 30 of the depilation roller 24. As can be seen, this again yields the desired directions of rotation for the skin-tautening rollers 37 and 38. In the present case the diameters of the skin-tautening rollers 37, 38 are selected to be slightly greater than the maximum diameter of the depilation rollers 23, 24, 25 and 26, so that the skin-tautening rollers are in even more intimate contact with the skin and thereby provide an effective skin-tautening action.

Figure 11:
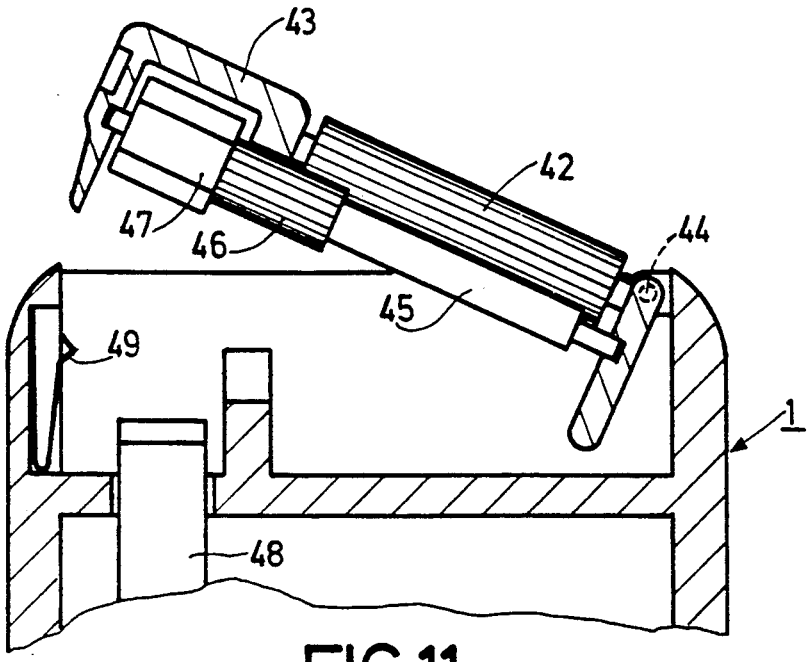
FIG. 11 shows a depilation apparatus in which the depilation rollers are arranged on a support which is arranged on the apparatus so as to be pivotable away from said apparatus.

FIG. 11 shows a depilation apparatus in which the depilation rollers, of which a roller 42 is visible, are arranged on a support 43 which is arranged on the apparatus via pivots 44 so as to be pivotable away from the apparatus. To drive the depilation rollers a shaft 45, which is rotatably journalled on the support 43, carries a gear wheel 46, which cooperates with the undulatory cross-sectional profile of the circumferential surface of the adjacent depilation roller 42, and a further gear wheel 47, which cooperates with a gear wheel 48 which projects from the apparatus housing and which is driven by the motor when the support 43 is in its swung-down position on the apparatus, in which position it is held by a latching spring 49. Since in the present case the depilation rollers are arranged on a support 43 which can be swung away from the apparatus, the depilation rollers can be cleaned easily at both sides, for example by means of a brush, when the support 43 is tilted away from the apparatus.

Figure 12:
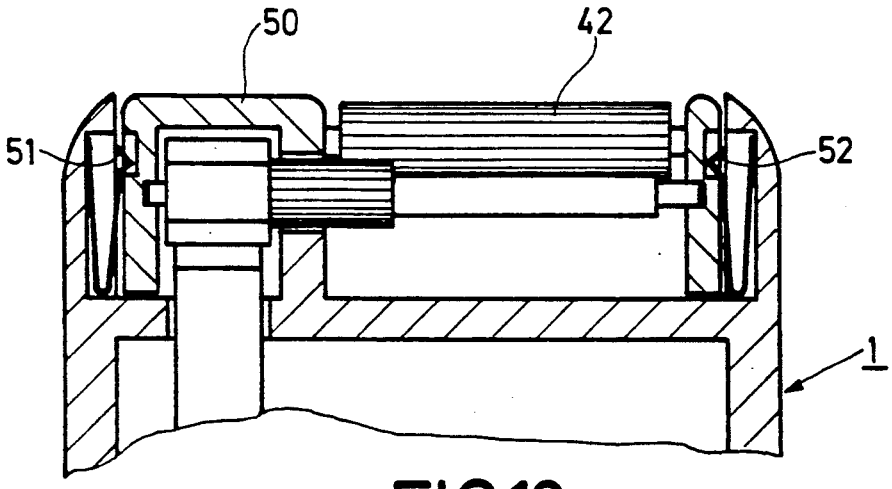
FIG. 12 shows a depilation apparatus in which the depilation rollers are arranged on a support which is detachably connected to the apparatus.

As a modification to the embodiment shown in FIG. 11 the depilation rollers 42 in the embodiment shown in FIG. 12 are arranged on a support 50 which is detachably connected to the apparatus, which in this case is effected by means of latching springs 51 and 52. In this way the depilation rollers together with the support 50 can be removed completely from the apparatus, so that they are again easy to clean. By means of such a support 50 which is bodily removable from the apparatus the depilation rollers can also be exchanged simply by placing another support onto the apparatus.

As will be apparent from the foregoing various modifications to the above embodiments are possible without departing from the scope of the invention, which applies in particular to the choice of the dimensioning of the depilation rollers and the shape of the undulatory cross-sectional profiles of their circumferential surfaces.

We claim:

1. A depilation apparatus comprising at least one pair of depilation rollers which are rotatable in opposite directions and whose circumferential surfaces have an undulatory cross-sectional profile with a maximum and a minimum diameter and at least four crests, which rollers interengage circumferentially with their cross-sectional profiles, one of said rollers being adapted to be driven by means of a motor, the depilation rollers performing a rotary movement which at the location where they interengage circumferentially is directed into the interior of the apparatus, wherein the undulatory cross-sectional profile extends linearly over the whole length of each depilation roller, the maximum diameter of the depilation rollers is selected to be of the order of magnitude of 4.5 mm, and the number of crests of the cross-sectional profile is selected to be of the order of magnitude of 10, a skin-tautening roller being arranged at either side adjacent the depilation rollers, said skin-tautening roller having a diameter larger than the maximum diameter of the depilation rollers and being driven in a direction of rotation which is directed away from the apparatus at the location of the adjacent depilation rollers.

2. A depilation apparatus as claimed in claim 1, in which the undulatory cross-sectional profile of the circumferential surfaces of the depilation rollers is sinusoidal, the depilation rollers intermesh tightly at the location of their maximum diameter and at the location of their minimum diameter respectively, and the ratio of the maximum diameter to the difference between maximum and the minimum diameter is selected to be of the order of magnitude of 7.

3. A depilation apparatus as claimed in claim 1, wherein the undulatory cross-sectional profile of the circumferential surfaces of the depilation rollers is a toothed-wheel profile having teeth with rounded tops, the depilation rollers intermeshing tightly only at the location of the tooth flanks of their cross-sectional profiles.

4. A depilation apparatus as claimed in claim 3, wherein the toothed-wheel profile is involute.

5. A depilation apparatus as claimed in claim 1, wherein the depilation rollers are driven with a speed of the order of magnitude of 1500 revolutions per minute.

6. A depilation apparatus as claimed in claim 1, comprising at least two pairs of depilation rollers which, viewed in a direction transverse to the longitudinal direction of the depilation rollers, are arranged opposite one another in spacedapart pairs, wherein the depilation rollers of two pairs are driven by means of a motor-driven gear wheel, which gear wheel, viewed in a direction transverse to the longitudinal direction of the depilation rollers, drives the forward depilation roller of the depilation rollers of the both pairs.

7. A depilation apparatus as claimed in claim 6, wherein every further pair of depilation rollers is driven by the adjacent depilation roller via gear wheels connected to the depilation rollers.

8. A depilation apparatus as claimed in claim 1, wherein the depilation rollers are arranged on a support, which support is arranged on the apparatus so as to be pivotable away from the apparatus.

9. A depilation apparatus as claimed in claim 1, wherein the depilation rollers are arranged on a support which is detachably connected to the apparatus.

10. A depilation apparatus comprising at least one pair of depilation rollers which are rotatable in opposite directions and whose circumferential surfaces have an undulatory cross-sectional profile with a maximum and a minimum diameter and at least four crests, which rollers interengage circumferentially with their cross-sectional profiles, one of said rollers being adapted to be driven by means of a motor, the depilation rollers performing a rotary movement which at the location where they interengage circumferentially is directed into the interior of the apparatus, wherein the undulatory cross-sectional profile extends linearly over the whole length of each depilation roller, the maximum diameter of the depilation rollers is selected to be of the order of magnitude of 4.5 mm, and the number of crests of the cross-sectional profile is selected to be of the order of magnitude of 10, at least one of said depilation rollers being supported on pivotable arms by means of which it is urged circumferentially against the adjacent depilation roller under spring action.

11. A depilation apparatus as claimed in claim 10 wherein a skin-tautening roller is arranged at either side adjacent the depilation rollers and is driven in a direction of rotation which is directed away from the apparatus at the location of the adjacent depilation rollers.

12. A depilation apparatus as claimed in claim 10 wherein the undulatory cross-sectional profile of the circumferential surfaces of the depilation rollers is sinusoidal, the depilation rollers intermesh tightly at the location of their maximum diameter and at the location of their minimum diameter respectively, and the ratio of the maximum diameter to the difference between maximum and the minimum diameter is selected to be of the order of magnitude of 7.

13. A depilation apparatus as claimed in claim 10 wherein the undulatory cross-sectional profile of the circumferential surfaces of the depilation rollers is a toothed-wheel profile having teeth with rounded tops, the depilation rollers intermeshing tightly only at the location of the tooth flanks of their cross-sectional profiles.

14. A depilation apparatus as claimed in claim 10 wherein the toothed-wheel profile is involute.

15. A depilation apparatus as claimed in claim 10 wherein the depilation rollers are driven with a speed of the order of magnitude of 1500 revolutions per minute.

16. A depilation apparatus as claimed in claim 10 wherein at least two pairs of depilation rollers which, viewed in a direction transverse to the longitudinal direction of the depilation rollers, are arranged opposite one another in spaced-apart pairs, wherein the depilation rollers of two pairs are driven by means of a motor-driven gear wheel, which gear wheel, viewed in a direction transverse to the longitudinal direction of the depilation rollers, drives the forward depilation roller of the depilation rollers of the both pairs.

17. A depilation apparatus as claimed in claim 16 wherein every further pair of depilation rollers is driven by the adjacent depilation roller via gear wheels connected to the depilation rollers.

18. A depilation apparatus as claimed in claim 10 wherein the depilation rollers are arranged on a support, which support is arranged on the apparatus so as to be pivotable away from the apparatus.

19. A depilation apparatus as claimed in claim 10 wherein the depilation rollers are arranged on a support which is detachably connected to the apparatus.

* * * * *